US009568864B2

(12) United States Patent
Suzuki et al.

(10) Patent No.: US 9,568,864 B2
(45) Date of Patent: Feb. 14, 2017

(54) FIXING DEVICE AND IMAGE FORMING APPARATUS

(71) Applicants: Naoto Suzuki, Kanagawa (JP); Yohhei Watanabe, Kanagawa (JP); Takashi Sakamaki, Kanagawa (JP); Masateru Ujiie, Kanagawa (JP)

(72) Inventors: Naoto Suzuki, Kanagawa (JP); Yohhei Watanabe, Kanagawa (JP); Takashi Sakamaki, Kanagawa (JP); Masateru Ujiie, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/993,565

(22) Filed: Jan. 12, 2016

(65) Prior Publication Data

US 2016/0202646 A1 Jul. 14, 2016

(30) Foreign Application Priority Data

Jan. 14, 2015 (JP) ..... 2015-005094
May 29, 2015 (JP) ..... 2015-109728

(51) Int. Cl.
*G03G 15/20* (2006.01)

(52) U.S. Cl.
CPC ..... *G03G 15/2025* (2013.01)

(58) Field of Classification Search
CPC ..... G03G 15/2085
See application file for complete search history.

(56) References Cited

U.S. PATENT DOCUMENTS

2001/0043825 A1* 11/2001 Kim ..... G03G 15/1605 399/307
2003/0007813 A1* 1/2003 Yasui ..... G03G 15/2025 399/324

(Continued)

FOREIGN PATENT DOCUMENTS

JP 55007725 A * 1/1980
JP H0667557 A 3/1994

(Continued)

OTHER PUBLICATIONS

JP_2001075402_A_T Machine translation, Nakamura, Mar. 2001, Japan.*

(Continued)

*Primary Examiner* — Minh Phan
*Assistant Examiner* — Victor Verbitsky
(74) *Attorney, Agent, or Firm* — Harness, Dickey & Pierce, P.L.C.

(57) ABSTRACT

A fixing device includes a fixing rotator, a pressing rotator, an oil applicator, a first adjuster, a surface modifier, a second adjuster, and a processor. The fixing rotator contacts a recording medium bearing a toner image. The pressing rotator forms a fixing nip with the fixing rotator. The oil applicator is pressed against at least one of applied members of the fixing rotator and pressing rotator. The first adjuster adjusts contact/separation of the oil applicator with respect to the applied member. The surface modifier contacts the fixing rotator to modify a surface thereof. The second adjuster adjusts contact/separation of the surface modifier with respect to the fixing rotator. The processor allows the surface modifier to modify the fixing rotator surface after the oil applicator contacts the applied member, and the oil applicator to separate from the applied member after the surface modifier is separated from the fixing rotator.

18 Claims, 7 Drawing Sheets

(56) References Cited

U.S. PATENT DOCUMENTS

| | | | | |
|---|---|---|---|---|
| 2007/0077103 | A1* | 4/2007 | Pino | G03G 15/2025 399/325 |
| 2007/0140754 | A1* | 6/2007 | Poxon | G03G 15/2025 399/327 |
| 2009/0274494 | A1* | 11/2009 | Okamoto | G03G 15/2025 399/325 |
| 2009/0274495 | A1 | 11/2009 | Okamoto et al. | |
| 2009/0274496 | A1 | 11/2009 | Okamoto et al. | |
| 2009/0274497 | A1 | 11/2009 | Okamoto et al. | |
| 2009/0274498 | A1 | 11/2009 | Okamoto et al. | |
| 2011/0076068 | A1* | 3/2011 | Kunugi | G03G 15/2028 399/323 |
| 2011/0222923 | A1 | 9/2011 | Watanabe | |
| 2014/0119787 | A1 | 5/2014 | Hasegawa | |
| 2015/0093128 | A1 | 4/2015 | Okamoto | |

FOREIGN PATENT DOCUMENTS

| | | | |
|---|---|---|---|
| JP | 2001075402 | A * | 3/2001 |
| JP | 2002-278347 | | 9/2002 |
| JP | 2002-318482 | | 10/2002 |
| JP | 2006-251722 | | 9/2006 |
| JP | 2006-259341 | | 9/2006 |
| JP | 2009-271175 | | 11/2009 |
| JP | 2009-271176 | | 11/2009 |
| JP | 2009-271239 | | 11/2009 |
| JP | 2009-271242 | | 11/2009 |
| JP | 2009-271245 | | 11/2009 |
| JP | 2009-271247 | | 11/2009 |
| JP | 2009-271248 | | 11/2009 |
| JP | 2010-217519 | | 9/2010 |
| JP | 2011-175067 | | 9/2011 |
| JP | 2011-191452 | | 9/2011 |
| JP | 2012-163907 | | 8/2012 |
| JP | 2014-021205 | | 2/2014 |
| JP | 2014-089234 | | 5/2014 |
| JP | 2014-164074 | | 9/2014 |
| JP | 2014-215376 | | 11/2014 |
| JP | 2015-075494 | | 4/2015 |
| JP | 2015-087738 | | 5/2015 |

OTHER PUBLICATIONS

U.S. Appl. No. 14/742,292, filed Jun. 17, 2015.
Extended European Search Report for Corresponding European Patent Application No. 16150330.5 issued on Sep. 20, 2016.

* cited by examiner

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application No. 2015-005094 filed on Jan. 14, 2015, and Japanese Patent Application No. 2015-109728 filed on May 29, 2015 in the Japan Patent Office, the entire disclosure of each of which is hereby incorporated by reference herein.

BACKGROUND

Technical Field

Exemplary aspects of the present invention relate to a fixing device and an image forming apparatus incorporating the fixing device.

Related Art

Contemporary image forming apparatuses such as copiers, printers, facsimile machines, or multifunction peripherals having two or more copying, printing, and facsimile functions are expected to improve energy saving efficiency, accelerate operation speed, and enhance image quality. However, thermal efficiency of a fixing device used in the image forming apparatus needs to be improved, and heat of various rollers in the fixing device needs to be controlled with precision to meet such recent market demands.

The image forming apparatus, which employs an image transfer method or a direct method, performs an image forming process to form an unfixed toner image on a recording medium (also referred to as a recording material or paper) such as a recording material sheet, printing paper, photosensitized paper, or electrostatic recording paper. The image forming process includes electrophotographic recording, electrostatic recording, and magnetic recording. A fixing device that employs a contact heating method is widely used to fix the unfixed toner image on the recording medium. The contact heating method includes a heating roller method, a belt fixing method, a film heating method, and an electromagnetic induction method.

Herein, the fixing device employing the heating roller method includes a fixing roller and a pressing roller as a rotation roller pair as a basic configuration. The fixing roller includes a heat source such as a halogen lamp, the temperature of which is adjusted to a predetermined temperature. The pressing roller is pressed by the fixing roller. A recording medium is conveyed to a contact portion called a fixing nip (also referred to as a nip portion) between the rotation roller pair, so that an unfixed toner image is fixed with heat and pressure applied by the fixing roller and the pressing roller.

On the other hand, the fixing device employing the belt fixing method includes a fixing roller disposed opposite a pressing roller, and an endless fixing belt (a fixing rotator) looped around the fixing roller and a heating roller. In a fixing nip formed by contacting the pressing roller and the fixing belt, heat from the heating roller is applied to a recording medium via the fixing belt, and an unfixed toner image is pressed to the recording medium to fix the unfixed toner image on the recording medium.

SUMMARY

In at least one embodiment of this disclosure, there is provided an improved fixing device that fixes a toner image on a recording medium with heat. The fixing device includes a fixing rotator, a pressing rotator, an oil applicator, a first adjuster, a surface modifier, a second adjuster, and a processor. The fixing rotator contacts the recording medium bearing the toner image, and the pressing rotator forms a fixing nip with the fixing rotator. The oil applicator, impregnated with oil, is pressed against at least one of applied members of the fixing rotator and the pressing rotator. The first adjuster adjusts contact and separation of the oil applicator with respect to the applied member. The surface modifier contacts the fixing rotator to modify a surface of the fixing rotator. The second adjuster adjusts contact and separation of the surface modifier with respect to the fixing rotator. The processor allows the surface modifier to contact the fixing rotator to modify the surface of the fixing rotator after the oil applicator contacts the applied member, and the oil applicator to separate from the applied member after the surface modifier is separated from the fixing rotator.

In at least one embodiment of this disclosure, there is provided an improved fixing device that fixes a toner image on a recording medium with heat. The fixing device includes a fixing rotator, a pressing rotator, an oil application surface modifier, and adjuster. The fixing rotator contacts the recording medium bearing the toner image, and the pressing rotator forms a fixing nip with the fixing rotator. The oil application surface modifier, impregnated with oil, is pressed against at least one of applied members of the fixing rotator and the pressing rotator, and modifies a surface of the applied member. The adjuster adjusts contact and separation of the oil application surface modifier with respect to the applied member.

In at least one embodiment of this disclosure, there is provided an improved fixing device that fixes a toner image on a recording medium with heat. The fixing device includes a fixing rotator, a pressing rotator, a cleaner, a lubricant applicator, and a processor. The fixing rotator contacts the recording medium bearing the toner image, and the pressing rotator forms a fixing nip with the fixing rotator. The cleaner is pressed against at least one of applied members of the fixing rotator and the pressing rotator to clean the applied member. The lubricant applicator applies lubricant to the cleaner or the applied member. If the recording medium is stuck in the fixing nip, the processor allows the lubricant applicator to apply the lubricant to the cleaner or the applied member at recovery.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
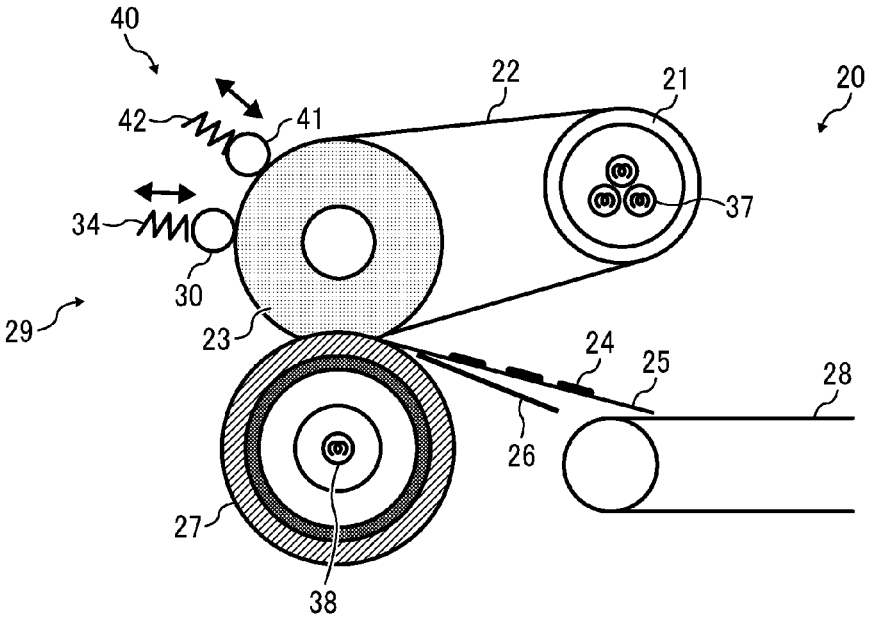
FIG. 1 is a diagram illustrating one example of a fixing device according to an exemplary embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF THE INVENTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have a similar function, operate in a similar manner, and achieve a similar result.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

Recently, an electrophotographic apparatus using a transparent toner and a white toner has been proposed in addition to a full color electrophotography that expresses an image with conventional toners of cyan, magenta, yellow and black. The use of such special color toners (transparent toner, white toner) can achieve a variety of expression, thereby generating a higher value-added output matter.

Herein, the phrase "generation of a higher value-added output matter by using the transparent toner" includes a case where an entire area of an image has uniform glossiness. An electrophotographic apparatus without a transparent toner barely outputs an image having uniform glossiness since a toner does not adhere to a blank portion of the image. Consequently, surface glossiness of paper as a recording medium is output as is. Moreover, a difference in glossiness due to a difference in toner amount adhering to paper is generated between a half-tone image to which a toner adheres in a dot manner and a solid image to which more toner adheres.

Moreover, the phrase "generation of a higher value-added output matter by using the white toner" includes a case where white color can be output on colored paper or metallic paper such as hologram. In a conventional full color electrophotographic apparatus, colors are expressed by adhesion of toners to white paper, whereas white is expressed by a ground color (white) of the paper. However, in a case where paper such as colored paper and metallic paper including hologram that does not have the white ground color is used, white cannot be expressed.

Accordingly, in the image forming apparatus including the special color toners (transparent toner, white toner), a special color toner image is sequentially formed on a conventional full color toner image (with cyan, magenta, yellow, and back toners), and both of the toner images are fixed at the same time. In such a case, a toner adhesion amount with respect to paper is greater than that for formation of the conventional full color toner image, and thus adherents (e.g., a toner additive component such as toner wax and silica) to a surface of a fixing rotator are generated by the toners. This degrades image quality, for example, by generation of an irregular image due to a heat amount difference of the fixing rotator or generation of an irregular image due to re-adhesion of the adherents of the fixing rotator to the paper. Moreover, adherents to a surface of a pressing rotator tend to be generated by the toners.

Moreover, such an increase in the toner adhesion amount with respect to the paper causes a separation failure in which the paper is wound around the fixing roller (particularly, when thin paper is used).

According to at least one of exemplary embodiments of the present invention described below, a failure associated with attachment or adhesion of foreign substances to a fixing rotator or a pressing rotator due to aging can be prevented, and a winding jam can be suppressed without lowering output image quality and productivity.

Hereinafter, exemplary embodiments of the present invention are described with reference to FIGS. 1 through 10.

First Exemplary Embodiment

A configuration of a fixing device 20 and control performed by a processor 10 according to an exemplary embodiment of the present invention are described with reference to FIG. 1.

Figure 10:
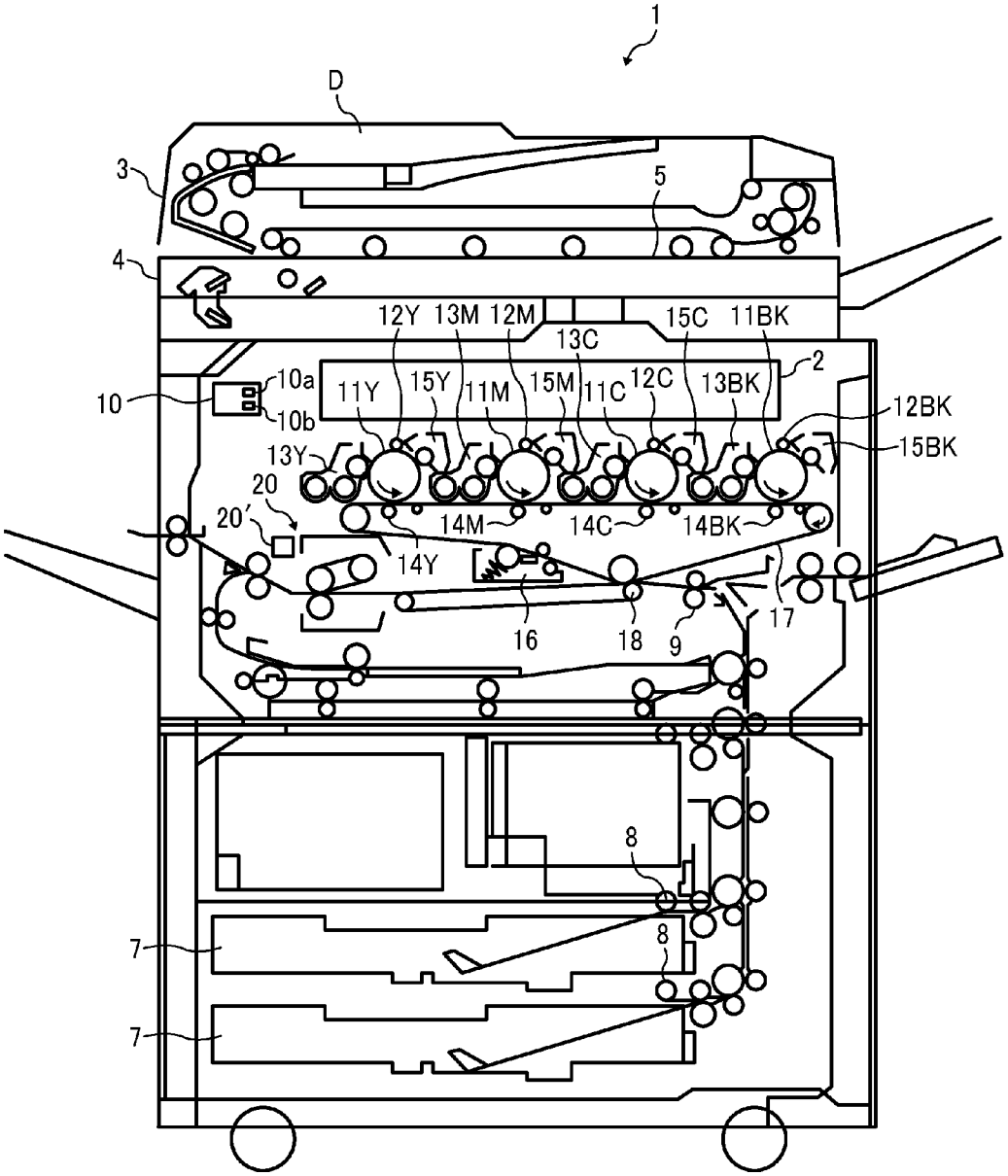
FIG. 10 is a diagram illustrating one example of an image forming apparatus according to an exemplary embodiment of the present invention.

In the schematic sectional view of FIG. 1, one example of the fixing device 20 in an axial direction of a fixing roller 23 is illustrated. The processor 10 for the fixing device 20 is disposed inside an image forming apparatus 1 that will described with reference to FIG. 10. The processor 10 comprehensively controls each device of the image forming apparatus 1 including the fixing device 20. However, alternatively, as illustrated in FIG. 10, the fixing device 20 may include a fixing processor 20' to control the fixing device 20 instead of the processor 10.

The fixing device 20 according to the present exemplary embodiment includes a fixing belt 22 as a fixing rotator to be heated by a heater 37, and a pressing roller 27 as pressing rotator. The pressing roller 27 can press the fixing belt 22 at least one location to form a fixing nip with the fixing belt 22. The fixing device 20 conveys a recording medium 25 bearing an unfixed toner image 24 to the fixing nip, thereby fixing the unfixed toner image 24 to the recording medium 25. Herein, the recording medium 25 is guided by a conveyance belt 28 and a guide plate 26 to the fixing nip. Moreover, the fixing device 20 includes a fixing rotator surface modifier 40 and an oil applicator 29. The fixing rotator surface modifier 40 is pressed against the fixing belt 22 to modify a surface of the fixing belt 22, whereas the oil applicator 29 is pressed against at least one of the fixing belt 22 and the pressing roller 27 to apply oil.

The fixing rotator surface modifier 40 is capable of contacting and separating from the fixing belt 22 according to a cumulative amount of time for which the recording medium 25 passes the fixing nip or a cumulative amount of toner adhering to the recording medium 25.

The oil applicator 29 is capable of contacting and separating from an applied member to which oil is applied. The oil applicator 29 contacts and separates from the applied member according to a type and a thickness of the recording medium 25 and a cumulative amount of toner adhering to the recording medium 25 passing the fixing nip.

The fixing device 20 according to the present exemplary embodiment is described in detail below.

The fixing device 20 includes a heating roller 21, the fixing roller 23, the fixing belt 22 looped around the heating roller 21 and the fixing roller 23, and the pressing roller 27 that presses the fixing roller 23 to form the fixing nip with the fixing roller 23. Moreover, the heating roller 21 includes the heater 37 as a heat source, whereas the pressing roller 27 includes a heater 38 as a heat source.

The fixing device 20 fixes the unfixed toner image on the recording medium 25 with heat and pressure when the recording medium 25 bearing the unfixed toner image 24 passes through the fixing nip between the fixing belt 22 and the pressing roller 27. The fixing nip is formed by contacting the fixing roller 23 and the pressing roller 27 against each other. Each of the heating roller 21, the fixing roller 23, and the pressing roller 27 is rotatably supported in a longitudinal direction of a casing (not illustrated) of the fixing device 20, and a drive unit (not illustrated) of each of the rollers is supported by the casing.

After passing the fixing nip, a leading end of the recording medium 25 is separated from the fixing nip by a separation plate (not illustrated) disposed near the fixing roller 23 or a separation plate (not illustrated) disposed near the pressing roller 27, and then proceeds to a next process. The separation plates as separators respectively disposed near the fixing roller 23 and the pressing roller 27 are not limited to the plate members. Alternatively, separation claws may be used. Moreover, a small gap is preferably provided between the separation plate or the separation claw and the fixing belt 22 or the pressing roller 27 from an image quality standpoint.

The heating roller 21 is, for example, a thin cylindrical member made of metal, and the heater 37 as a heat source is disposed inside the heating roller 21. For example, a halogen heater or a carbon heater can be used as the heater 37. Both ends of the heater 37 are fixed to the casing of the fixing device 20. Moreover, the heater 37 may be an induction heater for heating the heating roller 21 from outside.

An output of the heater 37 is controlled by a power source (an alternating current power supply), and the heating roller 21 is heated by radiant heat from the heater 37. Moreover, heat is applied from a surface of the fixing belt 22 heated by the heating roller 21 to the unfixed toner image 24 on the recording medium 25. The output of the heater 37 is controlled based on a belt surface temperature detected by a temperature sensor (not illustrated) such as a thermopile disposed opposite the surface of the fixing belt 22.

The fixing belt 22 is looped around the fixing roller 23 and the heating roller 21, and closely contacts the heating roller 21 and the fixing roller 23. The pressing roller 27 is pressed against such a fixing belt 22 at a portion corresponding to the fixing roller 23, thereby forming the fixing nip.

For example, the fixing belt 22 as a multi-layer endless belt includes an elastic layer made of silicone rubber and a release layer sequentially laminated on a base layer that is made of polyimide (PI) resin and has a thickness of 90 μm.

The elastic layer of the fixing belt 22 has a thickness of approximately 350 μm, and is made of an elastic material such as silicone rubber, fluoro rubber, and foamable silicone rubber. The release layer of the fixing belt 22 has a thickness of approximately 20 μm, and is made of, for example, perfluoroalkoxy (PFA), polyimide, polyetherimide, and polyether sulfide (PES). Arrangement of the release layer on a surface layer of the fixing belt 22 can provide good releasability (peelability) with respect to toner (a toner image).

Moreover, the fixing belt 22 includes, for example, a PI belt as a heat-resistant resin endless film having a thickness of 90 μm. The surface layer of the fixing belt 22 is coated with offset inhibitor such as PFA.

The fixing roller 23 includes a core covered with a thick elastic layer made of silicon rubber, the core being made of metal (e.g., iron, aluminum) having high rigidity. The fixing roller 23 does not include a heat source.

The pressing roller 27 as a rotator includes an elastic layer on a metal core made of a material such as a stainless used steel (SUS) 304. Similar to the fixing roller 23, the elastic layer of the pressing roller 27 is made of a material such as silicone rubber, fluoro rubber, and foamable silicone rubber. Moreover, the heater 38 as the heat source is disposed inside the cylindrical pressing roller 27. Alternatively, the pressing roller 27 may not include the heater 38.

The fixing roller 23 and the pressing roller 27 of the rubber rollers are disposed opposite each other. The pressing roller 27 is pressed in a center direction of the fixing roller 23 via the fixing belt 22, so that the fixing nip is formed between the pressing roller 27 and the fixing belt 22.

The drive unit rotates the fixing roller 23 in a clockwise direction. With the rotation of the fixing roller 23, the fixing belt 22 and the pressing roller 27 pressing the fixing roller 23 are rotated at the same speed.

The fixing device 20 includes the fixing rotator surface modifier 40 that is pressed against the fixing belt 22 as the fixing rotator to retain a surface property of the fixing belt 22. The fixing rotator surface modifier 40 is capable of contacting and separating with respect to the fixing rotator. The fixing rotator surface modifier 40 has a function of scraping/crushing/softening the surface of the fixing rotator, or absorbing foreign substances from the surface of the fixing rotator. The fixing rotator surface modifier 40 of the present exemplary embodiment includes a polishing roller 41 as a surface modifier that slides. The polishing roller 41 of the surface modifier 40 has a function of slightly scraping the surface of the fixing rotator and removing foreign substances from the surface of the fixing rotator. Note that the fixing rotator surface modifier 40 is not limited to the roller shape and instead may be the shape of sheet or rectangle.

The fixing rotator surface modifier 40 also includes an adjuster 42, as a second adjuster that enables the polishing roller 41 to contact and separate from the fixing belt 22. The adjuster 42 is not particularly limited, but can be a solenoid or cam unit including a drive motor. The polishing roller 41 can be a roller with abrasion marks that are directly transferred to metal or resin. Alternatively, the polishing roller 41 can be a roller on which abrasive grains are sprayed.

Moreover, the fixing device 20 includes the oil applicator 29 to maintain constant modifiability of the fixing belt 22 by the polishing roller 41 and enhance separability of the recording medium 25, with the oil applicator 29 being pressed against at least one of the fixing rotator and the pressing rotator to apply oil. The oil applicator 29 can contact and separate from an applied member to which the oil is applied. Hereinafter, the term "an applied member" represents at least one of the fixing rotator and the pressing rotator.

Moreover, the oil applicator 29 illustrated in FIG. 1 is described using an example in which the oil applicator 29 applies oil to the fixing belt 22. However, the oil applicator 29 is not limited thereto. Alternatively, the oil applicator 29 may apply oil to the pressing roller 27, for example. In FIG. 1, the oil applicator 29 includes an oil application roller 30 as an oil applicator and an adjuster 34 as a first adjuster. With the adjuster 34, the oil application roller 30 can contact and separate from the fixing belt 22. The adjuster 34 is not limited to any particular adjuster. The adjuster 34 can be a solenoid or cam unit including a drive motor. The oil application roller 30 may be an oil-impregnated roller such a sponge roller. Alternatively, the oil application roller 30 may include an oil supply path.

When the polishing roller 41 is pressed against the fixing belt 22 to remove foreign substances/adherents from the fixing belt 22, the polishing roller 41 may dig slightly into the fixing belt 22 at the beginning of rotation. In such a case, the polishing roller 41 locally polishes the fixing belt 22 in an excessive manner (a polishing depth may be deeper than necessary). A difference in the localized polishing depths on the fixing belt 22 causes generation of an irregular image on which gloss unevenness is provided or to which streaks are transferred. Accordingly, before the polishing roller 41 is pressed against the fixing belt 22, oil is applied to the fixing belt 22 to prevent such damage. The application of oil can eliminate a case where the polishing roller 41 excessively digs into the fixing belt 22, so that the fixing belt 22 is uniformly polished. This prevents generation of an irregular image caused by the polishing unevenness.

Similarly, when the polishing roller 41 is pressed against the fixing belt 22 while being rotated, oil can be applied to the fixing belt 22 prior to the polishing. The application of oil can prevent generation of an irregular image due to a greater localized polishing depth caused by a situation where the polishing roller 41 digs into the fixing belt 22 when contacting the fixing belt 22. Moreover, oil may be continuously applied during which the fixing belt 22 is being polished by the polishing roller 41. In such a case, polishing unevenness during the polishing is prevented.

After being polished by the polishing roller 41, the fixing belt 22 is in a state that separation supplemental oil and the foreign substances/adherents are removed therefrom. After polishing the fixing belt 22, the polishing roller 41 is separated from the fixing belt 22. The oil application roller 30 is pressed against the applied member to apply oil even after the polishing roller 41 and the fixing belt 22 are separated from each other. Thus, good separability of the recording medium 25 can be obtained.

In the fixing rotator surface modifier 40, polishability is lowered by clogging of the polishing roller 41, and a surface layer thickness of the fixing belt 22 is limited. Consequently, usage of the polishing roller 41 needs to be controlled. For example, the processor 10 has a function as a counter 10*a* for counting a time period for which the recording medium 25 passes the fixing nip, so that the polishing roller 41 is pressed against the fixing belt 22 if a cumulative time for which the recording medium 25 passes the fixing nip exceeds a predetermined time. This can modify the surface of the fixing belt 22 and prevent generation of an irregular image while suppressing the usage of the polishing roller 41.

A main component of the adherents to the fixing belt 22 is a toner additive component such as toner wax and silica from toner. The processor 10 has a function as a determiner 10*b* for determining a toner density and a toner adhesion area ratio of toner that adheres to the recording medium 25. If a cumulative toner density or toner adhesion area ratio of the toner passing the fixing nip exceeds a predetermined value, the polishing roller 41 is pressed against the fixing belt 22. This can modify the surface of the fixing belt 22 and prevent generation of an irregular image while suppressing the usage of the polishing roller 41.

Figure 2:
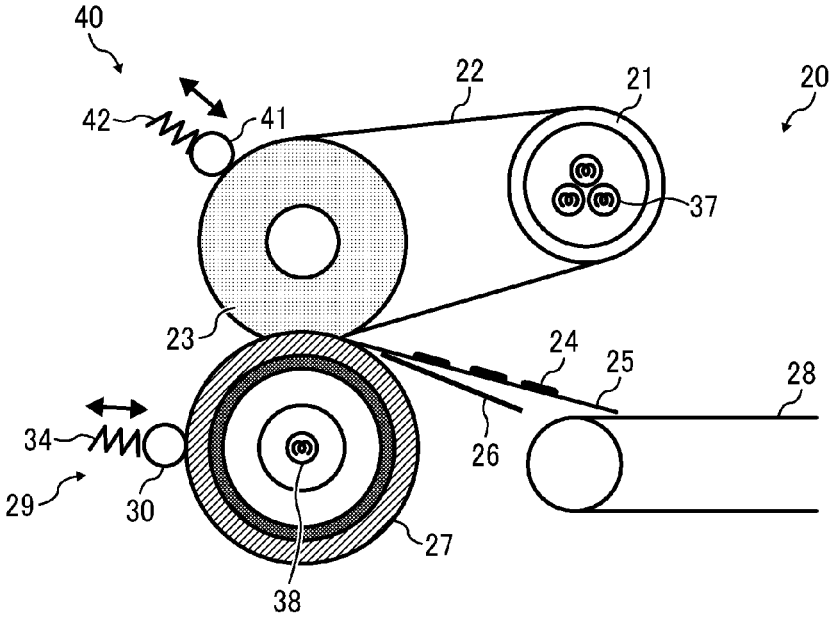
FIG. 2 is a diagram illustrating another example of the fixing device according to the exemplary embodiment of the present invention.

The oil applicator 29 contacts the fixing belt 22 in a relative position illustrated in FIG. 1. However, the oil applicator 29 may contact the pressing roller 27 as illustrated in FIG. 2.

Figure 3:
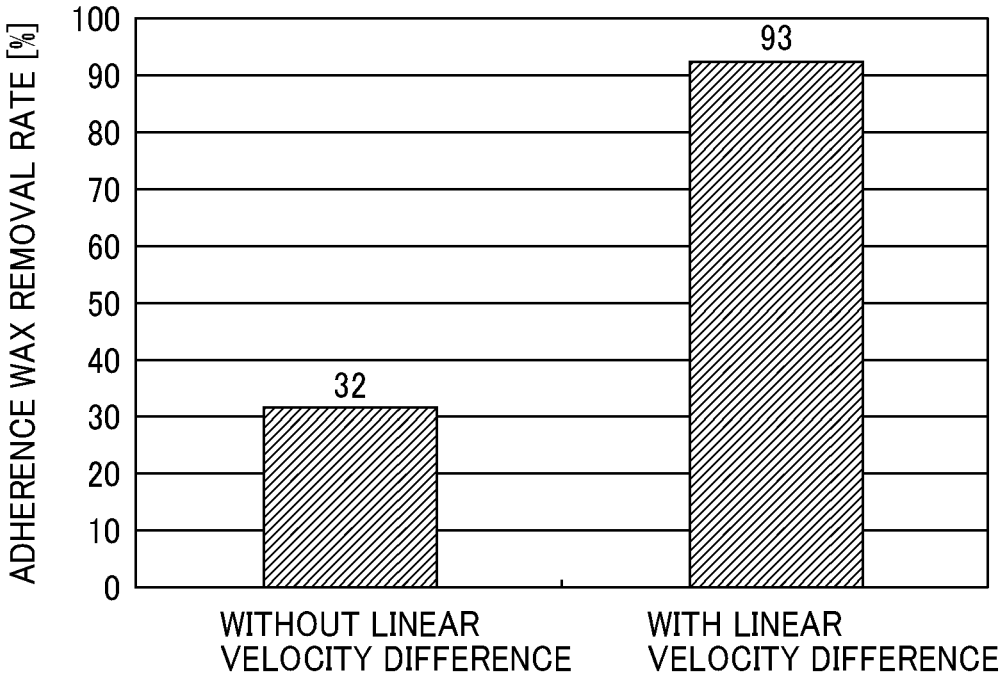
FIG. 3 is a graph illustrating a difference in foreign substance removal rate depending on the presence or absence of a linear velocity difference between a fixing belt and a polishing roller.

FIG. 3 illustrates an adherence wax removal rate on the fixing belt 22 when the fixing belt 22 is polished by the polishing roller 41. In FIG. 3, the left side of the graph represents a case where there is no linear velocity difference between the fixing belt 22 and the polishing roller 41, whereas the right side of the graph represents a case where there is a linear velocity difference between the fixing belt 22 and the polishing roller 41.

As for calculation of the adherence wax removal rate, an equal amount of toner wax is attached to the fixing belt 22, and a weight of the fixing belt 22 is measured before and after the fixing belt 22 is polished. For example, the adherence wax removal rate can be calculated as follows.

$$\text{Adherence wax removal rate [\%]} = \frac{(\text{belt weight [g] before fixing belt is refreshed} - \text{belt weight [g] after fixing belt is refreshed})}{(\text{belt weight [g] before fixing belt is refreshed} - \text{belt weight [g] without adherence of wax})} \times 100 \quad \text{Equation 1}$$

According to the graph illustrated in FIG. 3, an adherence wax removal rate in the presence of the linear velocity difference between the fixing belt 22 and the polishing roller 41 is almost three times greater than that in the absence of the linear velocity difference. The adherence toner wax on the fixing belt 22 can be removed more efficiently when the linear velocity difference between the fixing belt 22 and the polishing roller 41 is present.

In the present exemplary embodiment, a liner velocity difference is between three times and six times. However, a linear velocity difference may be set according to a fixing system.

In the oil application roller 30 such as an oil-impregnated roller, since an amount of oil that can be impregnated is limited, an oil usage needs to be controlled. For example, in a case where thick paper that does not need separation assistance (e.g., oil is applied to the fixing belt 22) is used, the oil application roller 30 is preferably separated from the fixing belt 22. On the other hand, in a case where thin paper that needs separation assistance is used, the oil application roller 30 preferably contacts the fixing belt 22. Such control can enhance separability of the recording medium 25 while suppressing the oil usage.

A type of oil to be applied to the applied member is not particularly limited as long as the oil can be used as lubricant. The fixing device 20 can include one oil applicator 29, or two or more oil applicators 29.

The oil application roller 30 is controlled so as to contact and separate from the applied member according to a thickness of the recording medium 25. A target paper thickness can be changed according to a purpose. For example, in a case where the recording medium 25 is thin paper, the oil application roller 30 is preferably controlled to press the applied member. Although a thickness of target thin paper can be changed according to a purpose, paper can be treated as oil application target thin paper, for example, if a thickness is 105 gsm or less.

Moreover, the oil application roller 30 is controlled to contact and separate from the applied member according to whether a special color toner including at least one of a transparent toner and a white toner is used. If the special color toner is used, separability with respect to the fixing rotator is degraded in the recording medium 25. Accordingly, when the special color toner is used, the oil application roller 30 is preferably controlled to press the applied member. Thus, more oil is applied, thereby enhancing separability of the recording medium 25 to which more toner adheres.

Moreover, a press of the applied member by the oil application roller 30 is preferably controlled according to a type of the recording medium 25. The separability of the recording medium 25 may not be enough depending on a type of recording medium 25. In some cases, the recording medium 25 may not be separated. Accordingly, the recording medium 25 the type of which has a disadvantage in fixing separation conveyance passes, the oil application roller 30 contacts the applied member to apply oil to the applied member. This can enhance the separability of the recording medium 25.

Herein, a type of the recording medium 25 as an oil application target can be changed according to a purpose. However, for example, oil application can be controlled according to non-coated paper or coated paper. If the non-coated paper having a disadvantage in separation is used, the oil application roller 30 can be controlled to contact the applied member. If the coated paper is used, the oil application roller 30 can be controlled to separate from the applied member.

The fixing device 20 may include an identification unit for identifying a thickness of the recording medium 25, the presence or absence of a special color toner, and a paper type of the recording medium 25 as needed. The identification unit is not particularly limited. For example, the identification unit can be a detector including a photo sensor. If a photo sensor for detecting a light transmission amount is used, a thickness of the recording medium 25 can be detected based on a difference in amount of light that transmits the recording medium 25.

The exemplary embodiment has been described using an example in which the fixing device 20 employs the belt fixing method. However, the exemplary embodiment is not limited thereto. For example, the exemplary embodiment may be applied to a fixing device employing another method such as a roller fixing method and a film fixing method. In the roller fixing method, a pressing roller and a heating roller (a fixing roller) contact each other to form a fixing nip. In the film fixing method, a film member looped around a fixing roller and a heating roller is used instead of a fixing belt as a belt member.

Figure 4:
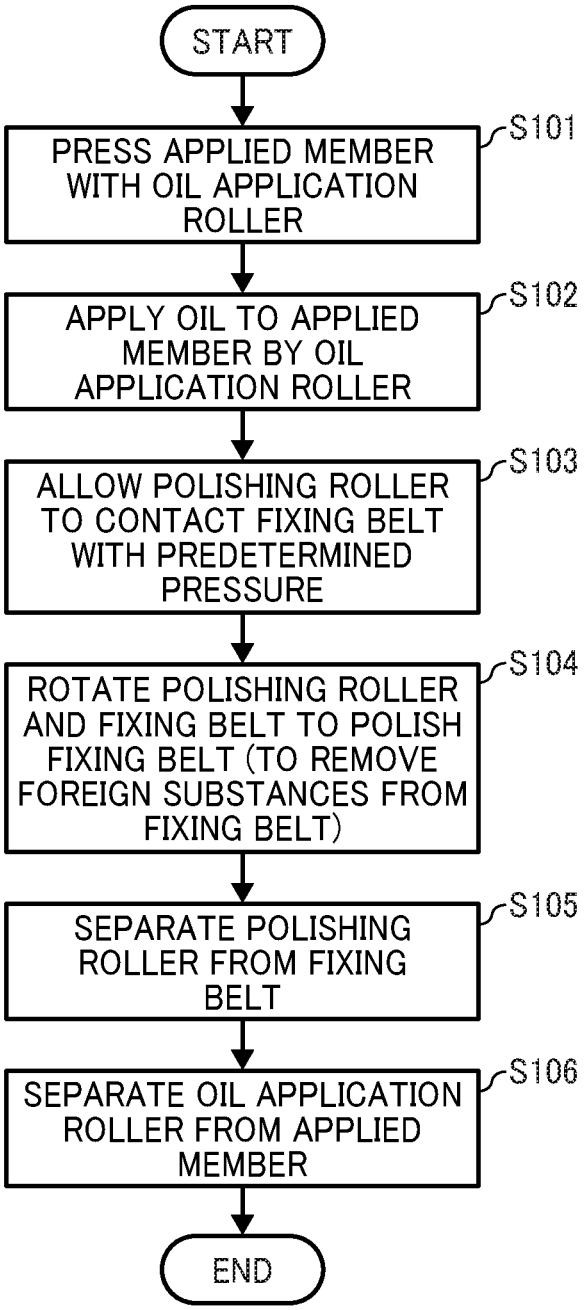
FIG. 4 is a flowchart illustrating steps in a fixing belt polishing operation.

FIG. 4 is a flowchart illustrating a series of steps in a fixing belt polishing process. In step S101, the oil application roller 30 is pressed against the applied member being rotated. In step S102, the oil application roller 30 applies oil to the applied member for a certain amount of time. Subsequently, in step S103, the polishing roller 41 contacts the fixing belt S122 with a predetermined pressure. In step S104, the polishing roller 41 rotates with the fixing belt 22 for a certain amount of time to scrape a surface of the fixing belt 22, so that toner wax adhering or attached to the surface of the fixing belt 22 is removed. In step S105, the polishing roller 41 is separated from the fixing belt 22. Subsequently, in step S106, the oil application roller 30 applies oil to the applied member for a certain amount of time, and is then separated from the applied member.

Second Exemplary Embodiment

Hereinafter, a fixing device according to another exemplary embodiment of the present invention is described. Components and configurations that are similar to the above exemplary embodiment will be given the same reference numerals as above and description thereof will be omitted.

Figure 5:
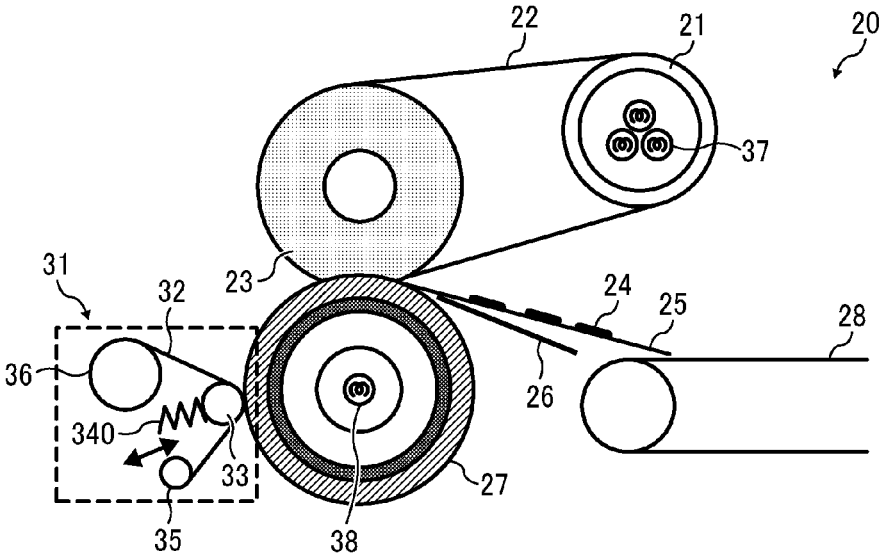
FIG. 5 is a diagram illustrating one example of a fixing device according to another exemplary embodiment of the present invention.

A fixing device 20 illustrated in FIG. 5 includes a cleaning web unit 31 as another exemplary embodiment of the oil applicator 29 described above. As illustrated in FIG. 5, the cleaning web unit 31 includes a cleaning web 32 as a cleaner, and a pressure roller 33 as a pressure member for pressing the cleaning web 32 to a pressing roller 27 by an adjuster 340. With the adjuster 340, the cleaning web unit 31 is capable of contacting and separating from the pressing roller 27.

The present exemplary embodiment is described using an example in which the cleaning web unit 31 is capable of contacting and separating from the pressing roller 27, but is not limited thereto. The cleaning web unit 31 may be able to contact and separate from a fixing belt 22 or a fixing roller (if a roller fixing method is employed).

In the fixing device 20, toner may adhere to the fixing belt 22, a fixing roller 23, and the pressing roller 27. Such toner adhesion can generate stains on the fixing belt 22, the fixing roller 23, and the pressing roller 27, causing degradation in separability of a recording medium 25 and generation of an irregular image. Consequently, the fixing device 20 preferably has a cleaning function. In the cleaning web unit 31, the cleaning web 32 cleans the stain on the pressing roller 27. The cleaning web 32 is fed little by little by a cleaning web supply roller 35, and is then wound around a cleaning web winding roller 36. This enables a clean surface of the cleaning web 32 to contact the pressing roller 27, so that the pressing roller 27 is cleaned.

Moreover, the cleaning web unit 31 can serve as an oil application surface modifier that has a sliding function and an oil application function in addition to the cleaning function of the original function. The sliding function is used so that modifiability of a surface modifier is maintained constant, whereas the oil application function is used for separation assistance. Such a cleaning web unit 31 can not only clean offset toner on the fixing belt 22 and the pressing roller 27, but also enhance uniform polishability and separability in the surface modifier by oil application.

Moreover, the cleaning web 32 as a cleaner preferably has a long sheet shape. In comparison with an oil application roller 30, the use of the long-sheet-shaped cleaning web 32 impregnated with oil can increase an amount of oil impregnation. Hence, a maintenance cycle can be extended, thereby prolonging the lifespan of the apparatus.

Next, a description is given of an example of controlling contact and separation of the oil applicator 29 in the fixing device 20 as illustrated in FIGS. 1, 2, and 5. The control example is illustrated in TABLE 1.

In TABLE 1, a term "special color toner" indicates that a special color toner is used, regardless of whether full color toners (Y, M, C, BK) are used at the same time as the special color toner.

In the control example illustrated in TABLE 1, a thickness of thin paper is 105 gsm or less, whereas a thickness of thick paper is 105 gsm or greater. A surface of coated paper is coated with white pigment and has good smoothness.

In TABLE 1, terms "contact" and "separation" represent that the oil applicator 29 contacts and separates from the applied member, which is at least one of the fixing rotator and the pressing rotator.

TABLE 1

CONTACT AND SEPARATION OF PRESSING ROLLER

| PAPER TYPE | | FULL COLOR TONER | SPECIAL COLOR TONER |
|---|---|---|---|
| NON-COATED PAPER | THIN PAPER | CONTACT | CONTACT |
| | THICK PAPER | CONTACT | CONTACT |
| COATED PAPER | THIN PAPER | CONTACT | CONTACT |
| | THICK PAPER | SEPARATION | SEPARATION |

In the example illustrated in TABLE 1, the oil applicator 29 is controlled to contact and separate from the applied member according to paper thickness of a recording medium and the presence or absence of special color toner use. The control is also performed according to a paper type (coated paper/non-coated paper). Therefore, a paper-winding jam in the fixing roller can be prevented.

As described above, in the image forming apparatus including the special color toner, a special color toner image is sequentially formed on a conventional full color toner image, and both of the toner images are fixed at the same time. Accordingly, a toner adhesion amount with respect to paper is greater than that in formation of the conventional full color image.

Consequently, in a case where paper with the full color toners and the special color toner is stuck (a paper jam occurs) in a fixing device, a cleaning unit needs to clean and collect a larger amount of unfixed toner since the toner adhesion amount with respect to the paper is greater.

Accordingly, in a case where a large amount of unfixed toner needs to be cleaned, for example, in a case where paper with full color toners and a special color toner is jammed, a fixing device according to each of exemplary embodiments described below can execute a cleaning operation without lowering productivity while preventing adhesion of a cleaning unit to a member to be cleaned when recovering from the paper jam.

Third Exemplary Embodiment

A configuration and a control operation of a fixing device according to another exemplary embodiment of the present invention are described with reference to FIG. 6. In a schematic sectional view of FIG. 6, one example of a fixing device 20 in an axial direction of a fixing roller 23 is illustrated. Components and configurations that are similar to the above description will be given the same reference numerals as above and description thereof will be omitted.

Figure 6:
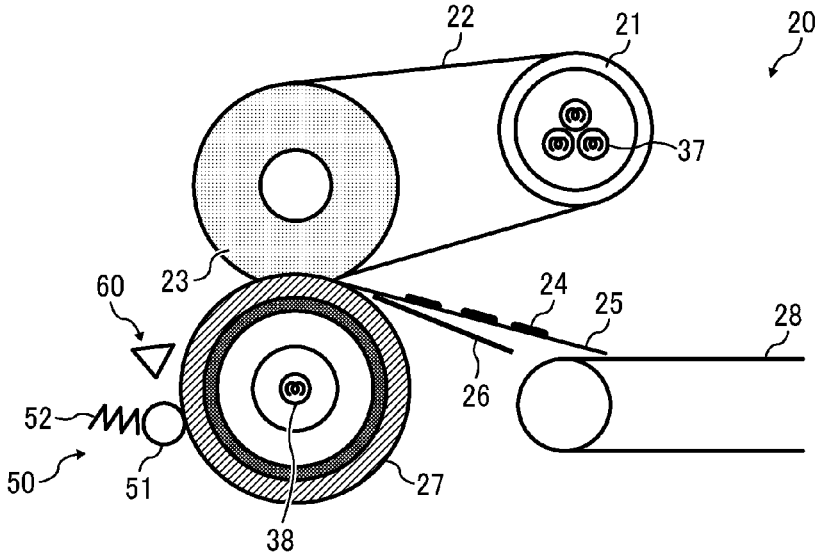
FIG. 6 is a diagram illustrating one example of a fixing device according to still another exemplary embodiment of the present invention.

The fixing device 20 illustrated in FIG. 6 includes a cleaning device 50 as another exemplary embodiment of the oil applicator 29 described above. The cleaning device 50 includes a cleaning roller 51 as a cleaner, and is presses against at least one of a fixing belt 22 and a pressing roller 27 to clean the fixing belt 22 or the pressing roller 27.

In the example diagram illustrated in FIG. 6, the cleaning device 50 is in contact with the pressing roller 27. However, the cleaning device 50 may be able to contact the fixing belt 22 or a fixing roller (if a roller fixing method is employed) instead of or in addition to contacting the pressing roller 27.

In the cleaning device 50, the cleaning roller 51 of a porous roller (e.g., a silicone sponge roller) impregnated with oil (e.g., silicone oil) is urged by a pressure spring 52 as a pressure member, thereby contacting the pressing roller 27.

The cleaning device 50 may include an adjuster with respect to the pressing roller 27 to contact and separate from the pressing roller 27 as similar to the oil applicator 29 of the above exemplary embodiment. The adjuster is not particularly limited. For example, the adjuster can be a solenoid or cam unit including a drive motor.

Moreover, the fixing device 20 includes a lubricant applicator 60 for applying lubricant (oil) to the cleaning roller 51.

The lubricant applicator 60 supplies oil to the cleaning roller 51. In the present exemplary embodiment, the lubricant applicator 60 includes an oil container in which oil is stored, and a shutter controlled to be open and closed at predetermined times. The lubricant applicator 60 drops the lubricant from the oil container to the cleaning roller 51 when the shutter is opened at a predetermined time. Thus, the lubricant is applied to the cleaning roller 51.

The configuration of the lubricant applicator 60 is not particularly limited. Thus, for example, the lubricant applicator 60 may contact the cleaning roller 51 to apply lubricant to the cleaning roller 51.

Herein, a type of oil to be applied to the cleaning roller 51 is not particularly limited as long as the oil can be used as a lubricant. However, the oil to be applied to the cleaning roller 51 by the lubricant applicator 60 is preferably the same as that with which the cleaning roller 51 is impregnated.

This can not only eliminate a problem due to a difference between oil newly applied from the lubricant applicator 60 and oil impregnated into the cleaning roller 51, but also replenish the cleaning roller 51 with oil.

In the fixing device 20 according to the present exemplary embodiment, a recording medium 25 may be jammed in a fixing nip (a paper jam may occur). In such a case, the fixing device 20 applies oil from the lubricant applicator 60 to the cleaning roller 51 of the cleaning device 50 when recovering from the jam. This can prevent adhesion of the pressing roller 27 to the cleaning roller 51 and maintain cleanability without lowering productivity.

Fourth Exemplary Embodiment

A configuration and a control operation of a fixing device according to another exemplary embodiment of the present invention are described with reference to FIG. 7. In the schematic sectional view of FIG. 7, one example of a fixing device 20 in an axial direction of a fixing roller 23 is illustrated. Components and configurations that are similar to the above description will be given the same reference numerals as above and description thereof will be omitted.

Figure 7:
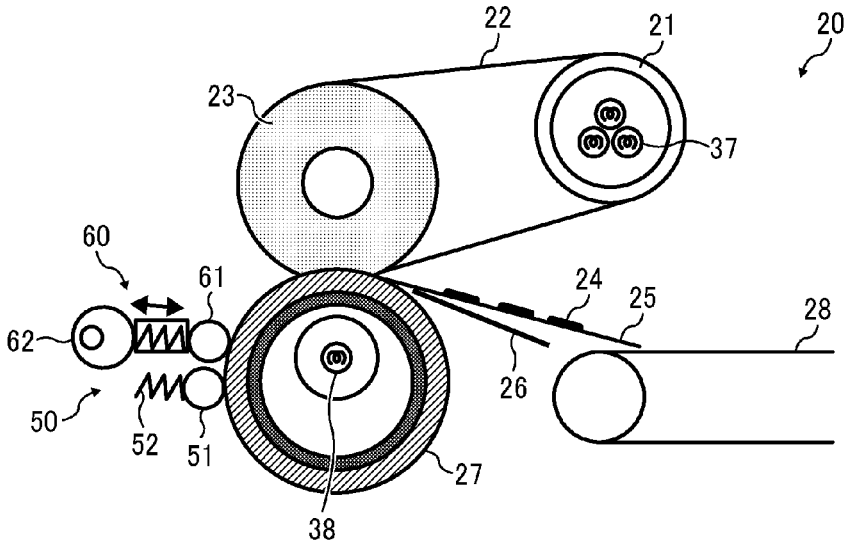
FIG. 7 is a diagram illustrating one example of a fixing device according to yet another exemplary embodiment of the present invention.

The fixing device 20 illustrated in FIG. 7 includes an oil application roller 61 as an oil supply member, and an adjuster 62 for the oil application roller 61. The oil application roller 61 and the adjuster 62 serve as a lubricant applicator 60, and the oil application roller 61 is capable of contacting and separating from a pressing roller 27.

In the example diagram illustrated in FIG. 7, a cleaning device 50 and the lubricant applicator 60 are in contact with the pressing roller 27. However, the cleaning device 50 and the lubricant applicator 60 may be able to contact a fixing belt 22 or a fixing roller (if a roller fixing method is employed) instead of or in addition to contacting the pressing roller 27.

The oil application roller 61 is not particularly limited. For example, the oil application roller 61 can be an oil-impregnated roller such as a sponge roller, or an oil application roller including an oil supply path through which oil is supplied. Moreover, the adjuster 62 is not particularly limited. For example, the adjuster 62 can be a solenoid or cam unit including a drive motor.

In the present exemplary embodiment, the oil application roller 61 is capable of contacting and separating from the pressing roller 27. The oil application roller 61 contacts the pressing roller 27 after a jam occurs. This can prevent adhesion of the cleaning roller 51 to the pressing roller 27.

In the present exemplary embodiment, moreover, the lubricant applicator 60 is preferably disposed with respect to a member that presses the cleaning device 50. That is, the lubricant applicator 60 and the cleaning device 50 are disposed with respect to the same member (herein, the pressing roller 27). Moreover, the lubricant applicator 60 is preferably disposed on an upstream side of the cleaning roller 51 in a rotation direction of the pressing roller 27.

Accordingly, lubricant to be applied to the pressing roller 27 by the lubricant applicator 60 can be promptly supplied to the cleaning roller 51. This can prevent adhesion of the cleaning roller 51 to the pressing roller 27 and maintain cleanability without lowering productivity.

In the fixing device 20 according to the present exemplary embodiment, a recording medium 25 may be jammed in a fixing nip. In such a case, the fixing device 20 applies oil from the lubricant applicator 60 to the pressing roller 27 when recovering from the jam. This can prevent adhesion of the cleaning roller 51 to the pressing roller 27 and maintain cleanability without lowering productivity.

Fifth Exemplary Embodiment

A configuration and a control operation of a fixing device according to another exemplary embodiment of the present invention are described with reference to FIG. 8. In a schematic sectional view of FIG. 8, one example of a fixing device 20 in an axial direction of a fixing roller 23 is illustrated. Components and configurations that are similar to the above description will be given the same reference numerals as above and description thereof will be omitted.

Figure 8:
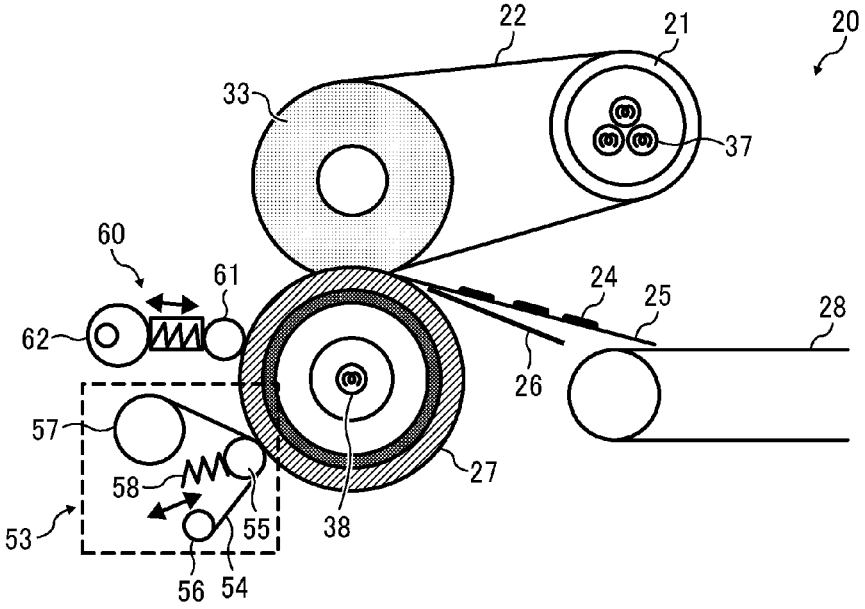
FIG. 8 is a diagram illustrating one example of a fixing device according to another exemplary embodiment of the present invention.

The fixing device 20 illustrated in FIG. 8 includes a cleaning web unit 53 as another exemplary embodiment of the cleaning device 50 described above. As illustrated in FIG. 8, the cleaning web unit 53 includes a cleaning web 54 as a cleaner, and a pressure roller 55 as a pressure member for pressing the cleaning web 54 to a pressing roller 27. Moreover, the cleaning web unit 53 is capable of contacting and separating from the pressing roller 27 using an adjuster 58.

The present exemplary embodiment is described using an example in which the cleaning web unit 53 is capable of contacting and separating from the pressing roller 27, but is not limited thereto. The cleaning web unit 53 may be able to contact and separate from a fixing belt 22 or a fixing roller (if a roller fixing method is employed).

In the cleaning web unit 53, the cleaning web 54 cleans a stain on the pressing roller 27. The cleaning web 54 is fed little by little by a cleaning web supply roller 56, and is then wound around a cleaning web winding roller 57. This enables a clean surface of the cleaning web 54 to contact the pressing roller 27, so that the pressing roller 27 is cleaned.

According to the present exemplary embodiment, the cleaning web unit 53 including the long-sheet-shaped cleaning web 54 impregnated with oil is used as the cleaning device 50. The use of such a cleaning web unit 53 can increase an amount of oil impregnation, compared to the use of the cleaning roller 51 (in each of the third and fourth exemplary embodiments). Hence, the lifespan of the cleaner can be prolonged, and a maintenance cycle can be extended.

Figure 9:
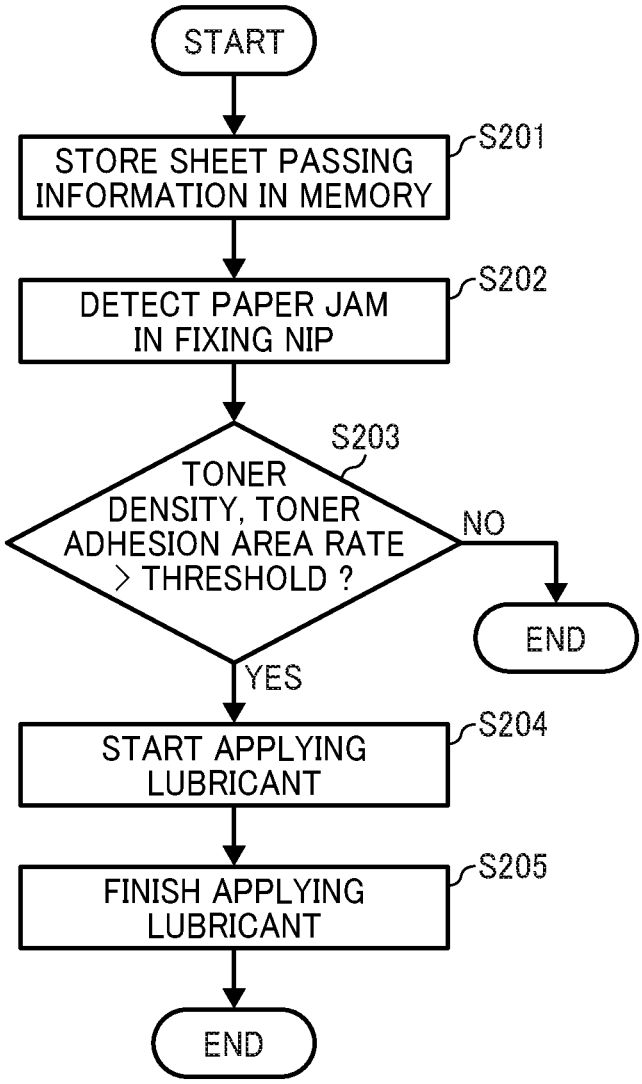
FIG. 9 is a flowchart illustrating one example of a lubricant application operation.

Next, a description is given of a lubricant application operation in the fixing device 20 including the lubricant applicator 60 (according to each of the third, fourth, and fifth exemplary embodiments). FIG. 9 is a flowchart illustrating steps in one example of a lubricant application operation according to the present invention.

The lubricant applicator 60 is preferably controlled whether to apply lubricant according a toner density or a toner adhesion area rate of paper jammed in a fixing nip based on sheet passing information stored beforehand in a storage unit (memory) in an apparatus body of the image forming apparatus 1.

In step S201, the image forming apparatus 1 stores sheet passing information in the memory. In step S202, the image forming apparatus 1 detects a paper jam in a fixing nip. In step S203, the image forming apparatus 1 determines whether a toner density and/or a toner adhesion area rate are respective predetermined thresholds or greater.

If the toner density and/or the toner adhesion area rate are the respective thresholds or greater (YES in step S203), the process proceeds to step S204 in which the lubricant applicator 60 starts applying lubricant. Subsequently, in step S205, the lubricant applicator 60 finishes applying the lubricant.

Moreover, when the image forming apparatus uses a special color toner, cleanability is lowered compared to when normal full color toners are used. Hence, when the special color toner is used, lubricant is preferably applied for a longer time in addition to normal operations.

Accordingly, the fixing device 20 includes the determination/record unit for determining/recording a toner density and a toner adhesion area rate at the time of paper jam. If the determination/record unit determines that the toner density and/or the toner adhesion area rate exceed respective predetermined values, lubricant is applied. This can suppress a lubricant consumption amount and extend the lifespan of the lubricant applicator 60.

<Image Forming Apparatus>

FIG. 10 is a schematic diagram illustrating a tandem-type color copier as one example of the image forming apparatus 1 according to the exemplary embodiment of the present invention. A configuration and operation of the image forming apparatus are described with reference to FIG. 10.

In FIG. 10, the image forming apparatus 1 includes a writing unit 2, a document conveyance unit 3, a document reading unit 4, a paper feeding unit 7, a registration roller 9, photoconductor drums 11Y, 11M, 11C, and 11BK, charging units 12Y, 12M, 12C, and 12BK, developing units 13Y, 13M, 13C, and 13BK, transfer bias rollers 14Y, 14M, 14C, and 14Bk, and cleaning units 15Y, 15M, 15C, and 15BK. The writing unit 2 emits a laser beam based on input image information. The document conveyance unit 3 conveys a document D to the document reading unit 4 for reading image information of the document D. The paper feeding unit 7 stores a recording medium P (not illustrated) such as a transfer paper. The registration roller 9 adjusts conveyance timing of the recording medium P. On the photoconductor drums 11Y, 11M, 11C, and 11BK, toner images of yellow, magenta, cyan, and black are respectively formed. The charging units 12Y, 12M, 12C, and 12BK respectively charge the photoconductor drums 11Y, 11M, 11C, and 11BK. The developing units 13Y, 13M, 13C, and 13Bk respectively develop electrostatic latent images formed on the photoconductor drums 11Y, 11M, 11C, and 11BK. The transfer bias rollers 14Y, 14M, 14C, and 14Bk as primary transfer bias rollers respectively transfer toner images formed on the photoconductor drums 11Y, 11M, 11C, and 11BK to the recording medium P by overlapping one another. The cleaning units 15Y, 15M, 15C, and 15BK respectively collect untransferred toners on the photoconductor drums 11Y, 11M, 11C, and 11BK.

Moreover, the image forming apparatus 1 includes an intermediate transfer belt cleaning unit 16, an intermediate transfer belt 17, a secondary transfer bias roller 18, and the fixing device 20. The intermediate transfer belt cleaning unit 16 cleans the intermediate transfer belt 17 to which toner images of plurality of colors are superimposed and transferred. The secondary transfer bias roller 18 is used to transfer the color toner image on the intermediate transfer belt 17 to the recording medium P. The fixing device 20 fixes the toner image on the recording medium P.

Hereinafter, a description is given of a normal color image forming operation performed by the image forming apparatus 1. First, a document D is conveyed from a document tray to a contact glass 5 of the document reading unit 4. Subsequently, the document reading unit 4 optically reads image information of the document D placed on the contact glass 5. Particularly, the document reading unit 4 scans the image of the document D on the contact glass 5 while irradiating the document D with light from an illumination lamp. The light reflected by the document D forms an image on a color sensor via a mirror group and a lens. The color sensor reads color image information of the document D with respect to each of color separation lights of red, green, and blue (RGB), and then converts the read information into electrical image signals. Moreover, an image processing unit performs processes such as a color conversion process, a color correction process, and a special frequency correction process based on the RGB color separation image signals to obtain image information of yellow, magenta, cyan, and black.

The image information of each of yellow, magenta, cyan, and black is transmitted to the writing unit 2. Subsequently, the writing unit 2 emits laser beams (exposure light) toward the photoconductor drums 11Y, 11M, 11C, and 11BK based on the image information of the respective colors.

Meanwhile, each of the four photoconductor drums 11Y, 11M, 11C, and 11BK is rotated counterclockwise in FIG. 10. First, surfaces of the photoconductor drums 11Y, 11M, 11C, and 11BK are uniformly charged in positions opposite the respective charging units 12Y, 12M, 12C, and 12BK (a charging process). Accordingly, charging potentials are formed on the photoconductor drums 11Y, 11M, 11C, and 11BK. Then, the charged surfaces of the photoconductor drums 11Y, 11M, 11C, and 11BK reach respective exposure positions in which the charged surfaces are irradiated with laser beams.

In the writing unit 2, four light sources emit laser beams each corresponding to the image signal for each color. The laser beams respectively pass optical paths for yellow, magenta, cyan, and black color components (an exposure process).

The laser beam corresponding to the yellow component is emitted onto the surface of the photoconductor drum 11Y, which is disposed on the far left among the four photoconductor drums 11 in the diagram illustrated in FIG. 10. Herein, the laser beam for the yellow component is scanned in a rotation axis direction (a main scanning direction) of the photoconductor drum 11Y by a polygon mirror that is rotating at high speed. Accordingly, an electrostatic latent image corresponding to the yellow component is formed on the photoconductor drum 11Y charged in advance by the charging unit 12Y.

Similarly, the laser beam corresponding to the magenta component is emitted onto the surface of the photoconductor drum 11M disposed on the second from the left among the four photoconductor drums 11 in the diagram illustrated in FIG. 10, so that an electrostatic latent image corresponding to the magenta component is formed. The laser beam corresponding to the cyan component is emitted onto the surface of the photoconductor drum 11C disposed on the third from the left among the four photoconductor drums 11 in the diagram illustrated in FIG. 10, so that an electrostatic latent image corresponding to the cyan component is formed. The laser beam corresponding to the black component is emitted onto the surface of the photoconductor drum 11BK disposed on the fourth from the left among the four photoconductor drums 11 in the diagram illustrated in FIG. 10, so that an electrostatic latent image of the black component is formed.

Then, the surfaces of the photoconductor drums 11Y, 11M, 11C, and 11BK with the electrostatic latent images of the respective colors reach positions opposite the respective developing units 13Y, 13M, 13C, and 13Bk. The developing units 13Y, 13M, 13C, and 13Bk respectively supply color toners to the photoconductor drums 11Y, 11M, 11C, and 11BK, thereby developing the electrostatic latent images on the photoconductor drums 11Y, 11M, 11C, and 11BK to form toner images (a development process).

After the development process, the surfaces of the photoconductor drums 11Y, 11M, 11C, and 11BK reach respective positions opposite the intermediate transfer belt 17. Herein, in such positions, the transfer bias rollers 14Y, 14M, 14C, and 14Bk are arranged so as to contact an inner circumferential surface of the intermediate transfer belt 17. In positions of the transfer bias rollers 14Y, 14M, 14C, and 14Bk, the different-color toner images formed on the respective photoconductor drums 11Y, 11M, 11C, and 11BK are sequentially superimposed and transferred to the intermediate transfer belt 17 (a primary transfer process).

After the transfer process, the surfaces of the photoconductor drums 11Y, 11M, 11C, and 11BK reach positions opposite the respective cleaning units 15Y, 15M, 15C, and 15BK. Herein, the cleaning units 15Y, 15M, 15C, and 15BK respectively collect untransferred toners remaining on the photoconductor drums 11Y, 11M, 11C, and 11BK (a cleaning process).

Subsequently, the surfaces of the photoconductor drums 11Y, 11M, 11C, and 11BK pass respective discharging units (not illustrated), and a series of the image forming processes in each of the photoconductor drums 11Y, 11M, 11C, and 11BK ends.

Meanwhile, the intermediate transfer belt 17, bearing the toners superimposed and transferred from the respective photoconductor drums 11Y, 11M, 11C, and 11BK, moves clockwise in the diagram illustrated in FIG. 10, and reaches a position opposite the secondary transfer bias roller 18. The color toner image on the intermediate transfer belt 17 is transferred to a recording medium P in the position opposite the secondary transfer bias roller S118 (a secondary transfer process).

Subsequently, the surface of the intermediate transfer belt 17 reaches a position of the intermediate transfer belt cleaning unit 16 by which untransferred toner on the intermediate transfer belt 17 is collected. A series of the transfer processes in the intermediate transfer belt 17 ends.

Herein, the recording medium P conveyed to an area (a secondary transfer nip) between the intermediate transfer belt 17 and the secondary transfer bias roller 18 is conveyed from the paper feeding unit 7 via the registration roller 9.

In particular, the recording medium P stored in the paper feeding unit 7 is fed by a paper feeding roller 8. After passing a conveyance guide, the recording medium P is guided to the registration roller 9. Upon reaching the registration roller 9, the recording medium P is conveyed toward the secondary transfer nip at an appropriate time.

The recording medium P with a transferred full color image is guided to the fixing device 20 by the conveyance belt. The fixing device 20 fixes the color image (toner) onto the recording medium P in a fixing nip between the fixing roller as a fixing rotator and the pressing roller as a pressing rotator.

After the fixing process, the recording medium P is discharged outside the apparatus as an output image by a paper ejection roller, and a series of the image forming processes ends.

Therefore, the electrophotographic image forming apparatus according to the exemplary embodiments of the present invention repeatedly performs operations such as charging, writing, developing, transferring, cleaning, and discharging with respect to the photoconductor drums as image bearing members to sequentially form toner images and successively transfer the toner images to a recording medium such as a sheet and an overhead projector (OHP) film, thereby recording the image on the recording medium. The fixing device according to the exemplary embodiment of the present invention allows the recording medium with the transferred toner image to pass an area between the fixing rotator and the pressing rotator to fix the toner image on the recording medium. The fixing device conveys the recording medium while suppressing generation of an irregular image (e.g., gloss unevenness) due to adhesion of foreign substances or adherents to the fixing rotator and a separation failure of paper including thin paper and thick paper in the fixing rotator without degrading output image quality.

In particular, after the oil applicator is pressed against the fixing rotator, the surface modifier modifies a surface of the fixing rotator (the fixing rotator is refreshed). This can not only prevent generation of an irregular image due to re-adhesion of foreign substances/adherents on the fixing rotator to paper or polishing unevenness generated by the surface modifier, but also maintain separability of the paper from the fixing rotator.

Moreover, a time period for which the paper passes the fixing device 20 is counted. If a cumulative paper passing time exceeds a predetermined paper passing time, the surface of the fixing rotator is modified (the fixing rotator is refreshed). This can prevent generation of an irregular image due to re-adhesion of foreign substances/adherents on the fixing rotator to the paper or polishing evenness generated by the surface modifier.

In addition, a toner density and a toner adhesion area rate on the paper are determined. If the toner density or a toner adhesion area rate on the paper exceeds a predetermined amount, the surface of the fixing rotator is automatically modified (the fixing rotator is refreshed). This can prevent generation of an irregular image due to re-adhesion of foreign substances/adherents on the fixing rotator to the paper or polishing evenness generated by the surface modifier.

Moreover, the surface modifier contacts the fixing rotator to rotate with a linear velocity difference, thereby enhancing removability of foreign substances/adherents from the fixing rotator.

In addition, when paper the type of which has a disadvantage in separation from the fixing rotator passes, the oil applicator is pressed against the fixing rotator. The use of oil from the oil applicator can provide separability of the paper with respect to the fixing rotator.

With the function of determining a toner density and a toner adhesion area rate on the paper, the oil applicator is pressed against the fixing rotator if a toner adhesion amount exceeds a predetermined amount or greater. Thus, even if the paper has a higher toner adhesion amount, the use of oil from the oil applicator can provide separability of the paper with respect to the fixing rotator.

Moreover, in the cleaner including the oil supply unit, oil is applied to the fixing rotator, thereby providing separability of the paper with respect to the fixing rotator.

The cleaner includes a long-sheet-shaped cleaning web, so that the lifespan of the cleaner can be extended and separability of paper with respect to the fixing rotator can be obtained by oil impregnated into the cleaner.

The image forming apparatus according to the present exemplary embodiment includes the fixing device including the surface modifier capable of contacting and separating from the fixing rotator and the oil applicator capable of contacting and separating from the fixing rotator or a pressing rotator. Such an image forming apparatus is reliable by not only preventing generation of an irregular image due to re-adhesion of foreign substances/adherents on the fixing rotator to paper or polishing unevenness generated by the surface modifier, but also providing separability of the paper with respect to the fixing rotator.

According the image forming apparatus including the fixing device with the lubricant applicator, the cleaner is prevented from adhering to the fixing rotator or the pressing rotator, thereby obtaining fixing-cleanability without lowering productivity.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device that fixes a toner image on a recording medium with heat, the fixing device comprising:

a fixing rotator to contact the recording medium bearing the toner image;

a pressing rotator to form a fixing nip with the fixing rotator;

an oil applicator, impregnated with oil, to be pressed against at least one of applied members of the fixing rotator and the pressing rotator;

a first adjuster to adjust contact and separation of the oil applicator with respect to the applied member;

a surface modifier to contact and separate from the fixing rotator after the oil applicator roller contacts the applied member and before the oil applicator roller separates from the applied member;

a second adjuster to adjust contact and separation of the surface modifier with respect to the fixing rotator; and a processor configured to allow the surface modifier to contact the fixing rotator to modify the surface of the fixing rotator after the oil applicator contacts the applied member, and the oil applicator to separate from the applied member after the surface modifier is separated from the fixing rotator, wherein the processor is further configured to control the oil applicator to contact and separate from the applied member according to a thickness of the recording medium and a presence or absence of a special color toner.

2. The fixing device according to claim 1, further comprising a counter to count a time the recording medium passes the fixing device, wherein, if a cumulative paper passing time exceeds a predetermined time, the processor allows the oil applicator and the surface modifier to contact the applied member.

3. The fixing device according to claim 1, further comprising a determiner to determine a toner density and a toner adhesion area rate on the recording medium, wherein, if a cumulative toner adhesion amount exceeds a predetermined amount, the processor allows the oil applicator and the surface modifier to contact the applied member.

4. The fixing device according to claim 1, wherein the surface modifier contacts the fixing rotator to rotate with the fixing rotator with a linear velocity difference.

5. The fixing device according to claim 1, wherein the processor allows the oil applicator to contact the applied member according to a type of the recording medium which is to pass the fixing device.

6. The fixing device according to claim 1, further comprising a determiner to determine a toner density and a toner adhesion area rate on the recording medium, wherein, if the recording medium having the toner density or the toner adhesion area rate that exceeds a predetermined amount passes a fixing nip formed between the fixing rotator and the pressing rotator, the processor allows the oil applicator to contact the applied member.

7. The fixing device according to claim 1, wherein the oil applicator includes a cleaner with an oil supplier, wherein the cleaner includes a pressure member pressing the cleaner to the applied member, and wherein the press of the cleaner by the pressure member is released to separate the cleaner from the applied member.

8. An image forming apparatus comprising the fixing device of claim 1.

9. A fixing device that fixes a toner image on a recording medium with heat, the fixing device comprising:

a fixing rotator to contact the recording medium bearing the toner image;

a pressing rotator to form a fixing nip with the fixing rotator;

an oil application surface modifier, impregnated with oil, to be pressed against at least one of applied members of the fixing rotator and the pressing rotator and to clean toner from the fixing rotator and the pressing rotator and to modify a surface of the applied member; and an adjuster to adjust contact and separation of the oil application surface modifier with respect to the applied member based on a thickness of the recording medium and a presence or absence of a special color toner.

10. An image forming apparatus comprising the fixing device of claim 9.

11. A fixing device that fixes a toner image on a recording medium with heat, the fixing device comprising:

a fixing rotator to contact the recording medium bearing the toner image;

a pressing rotator to form a fixing nip with the fixing rotator;

a cleaner to be pressed against at least one of applied members of the fixing rotator and the pressing rotator to clean the applied member;

a lubricant applicator to apply lubricant to the cleaner or the applied member; and a processor, if the recording medium is stuck in the fixing nip, to determine and record a toner density and a toner adhesion area rate and if the processor determines that the toner density and/or the toner adhesion area rate exceed respective predetermined values, allow the lubricant applicator to apply the lubricant to the cleaner or the applied member at recovery, wherein the processor is further configured to control the lubricant applicator to contact and separate from the applied member according to a thickness of the recording medium and a presence or absence of a special color toner.

12. The fixing device according to claim 11, further comprising a counter to count a time the recording medium passes the fixing device, wherein, if a cumulative paper passing time exceeds a predetermined time, the processor allows the lubricant applicator and the cleaner to contact the applied member.

13. The fixing device according to claim 11, further comprising a determiner to determine a toner density and a toner adhesion area rate on the recording medium, wherein, if a cumulative toner adhesion amount exceeds a predetermined amount, the processor allows the lubricant applicator and the cleaner to contact the applied member.

14. The fixing device according to claim 11, wherein the cleaner contacts the applied member to rotate with the applied member with a linear velocity difference.

15. The fixing device according to claim 11, wherein the processor allows the lubricant applicator to contact the applied member according to a type of the recording medium which is to pass the fixing device.

16. The fixing device according to claim 11, further comprising a determiner to determine a toner density and a toner adhesion area rate on the recording medium, wherein, if the recording medium having the toner density or the toner adhesion area rate that exceeds a predetermined amount passes a fixing nip formed between the fixing rotator and the pressing rotator, the processor allows the lubricant applicator to contact the applied member.

17. The fixing device according to claim 11, wherein the cleaner includes a pressure member pressing the cleaner to the applied member, and wherein the press of the cleaner by the pressure member is released to separate the cleaner from the applied member.

18. An image forming apparatus comprising the fixing device of claim 11.

* * * * *